US008061827B2

(12) United States Patent
Iino

(10) Patent No.: US 8,061,827 B2
(45) Date of Patent: Nov. 22, 2011

(54) INK CARTRIDGE AND RECORDING APPARATUS

(75) Inventor: Yasushi Iino, Chiba (JP)

(73) Assignee: Seiko I Infotech Inc. (JP)

( * ) Notice: Subject to any disclaimer, the term of this patent is extended or adjusted under 35 U.S.C. 154(b) by 232 days.

(21) Appl. No.: 12/454,575

(22) Filed: May 19, 2009

(65) Prior Publication Data

US 2009/0289972 A1 Nov. 26, 2009

(30) Foreign Application Priority Data

May 23, 2008 (JP) ..... 2008-135965

(51) Int. Cl.
*B41J 2/175* (2006.01)
*B41J 2/195* (2006.01)
*B41J 29/393* (2006.01)

(52) U.S. Cl. ..... 347/86; 347/7; 347/19

(58) Field of Classification Search ..... 347/86, 347/7
See application file for complete search history.

(56) References Cited

U.S. PATENT DOCUMENTS 7,488,059 B1 * 2/2009 Holland et al. ..... 347/85
2003/0117467 A1 * 6/2003 Jung ..... 347/86
2007/0285482 A1 * 12/2007 Hamano ..... 347/86

* cited by examiner

*Primary Examiner* — Julian Huffman
*Assistant Examiner* — Tracey McMillion
(74) *Attorney, Agent, or Firm* — Adams & Wilks

(57) ABSTRACT

An ink cartridge has a flexible ink bag that stores ink and undergoes expansion and contraction movement in accordance with fluctuations in the amount of ink stored. The ink bag is accommodated in a housing and has an ink inlet port for supplying ink into the ink bag and an ink outlet port for discharging stored ink. An inflow port and an outlet port are formed in a front surface of the housing for connection to the ink inlet port and ink outlet port, respectively, of the ink bag. First and second detection windows are formed on respective first and second opposite side surfaces of the housing. A plate member is mounted on the ink bag for movement therewith in response to fluctuations in the amount of ink stored in the ink bag. The plate member has a protruding portion that closes the second detection window during movement thereof to detect the full state of the ink bag. A lever has a structure separate and independent from the plate member and is mounted to undergo movement with the plate member to close the first detection window to detect an empty state of the ink bag.

8 Claims, 11 Drawing Sheets

INK CARTRIDGE AND RECORDING APPARATUS

BACKGROUND OF THE INVENTION

The present invention relates to an ink cartridge for use in an inkjet-type recording apparatus that ejects ink droplets by nozzles, and records an image, a character and the like on a recording sheet, and relates to a recording apparatus including the ink cartridge.

At present, a large number of inkjet-type recording apparatuses (inkjet printers), each of which ejects ink droplets on a recorded medium such as a recording sheet, and records an image, a character and the like thereon, are provided. Each of these inkjet printers supplies ink to a recording head through an ink supply tube from a main tank in an inside of which the ink is hermetically filled in advance, and ejects the ink droplets from nozzles of the recording head on the recording sheet, thereby performs such recording.

As a type of the inkjet printers as described above, there is one in which a sub tank serving as an ink container with a smaller capacity than that of the main tank is provided between the main tank and the nozzles. In this type of the inkjet printer, the ink that is caused to flow out of the main tank is temporarily stored in the sub tank, and the stored ink is supplied from the sub tank to the nozzles.

In the inkjet printer including the sub tank, in order that the ink can always be supplied from the sub tank to the nozzles, it is necessary to grasp a residual amount of the ink in the sub tank, and to supply a fixed amount of the ink from the main tank to the sub tank when the ink in the sub tank runs out. As a mechanism for this purpose, for example, an ink residual amount detection mechanism described in Patent Document 1 is known.

The ink residual amount detection mechanism described in JP 2003-112433 A includes: a base member of a fixing system; a container (ink bag) that is freely expansible or contractible in response to a change of an amount of liquid ink stored in an inside thereof, in which one side thereof is disposed on the base member; a moving member (plate) that is disposed on the other side of the container so that the container can be located between the moving member concerned and the base member, and moves in response to the expansion or contraction of the container; a first detecting means for detecting one of end portions of the moving member that moves as the container expands by an increase of the amount of ink; a second detecting means for detecting the other end portion of the moving member that moves as the container contracts by a decrease of the amount of ink; and an abutting member against which the other end portion of the moving member that moves as the container expands by the increase of the amount of ink abuts.

Specifically, in the ink residual amount detection mechanism described in JP 2003-112433 A, the flexible ink bag is used as the sub tank, one of side surfaces of the ink bag is directly adhered onto the base member fixed to the inkjet printer, and the another side surface is adhered onto the moving member. Then, when the ink in the inside of the ink bag is decreased to a preset minimum amount or less, the other end portion of the moving member is detected by the second detecting means, and the ink is caused to flow into the ink bag from the main tank. After that, when the ink is caused to flow into the ink bag up to a preset maximum amount, the one end portion of the moving member is detected by the first detecting means, and such inflow of the ink is stopped.

In accordance with the mechanism as described above, the ink is always stored in the inside of the ink bag, and accordingly, the ink can always be supplied to the nozzles from the ink bag serving as the sub tank.

Incidentally, even with the above-mentioned ink bag that is used as the sub tank and supplied with the ink from the main tank, it is necessary to periodically exchange the ink bag since the ink bag itself is deteriorated with time.

However, the ink container for use in the above-mentioned ink residual amount detection mechanism described in Patent Document 1 is not one in which the ink bag is housed in a housing, but one in which the ink bag is directly adhered onto the inkjet printer, and accordingly, it has taken a lot of time and labor to exchange the ink bag. In addition, it has been necessary to accurately fix the ink bag to a predetermined position of the base member. In the case where the position to which the ink bag is fixed shifts from the predetermined position, the moving member adhered onto the ink bag is not accurately positioned with respect to the detecting means, and it has been possible that erroneous detection may occur regarding the residual amount of ink.

SUMMARY OF THE INVENTION

The present invention has been made in consideration for the above-mentioned circumstances. It is an object of the present invention to provide an ink cartridge that is capable of preventing the erroneous detection of the residual amount of ink, in which exchange work is easy. It is another object of the present invention to provide a recording apparatus including this ink cartridge.

In order to solve the above-mentioned problems, the present invention proposes the following means.

An ink cartridge of the present invention is characterized by including: a flexible ink bag configured to store ink and change a thickness thereof in response to an amount of the ink; a housing that houses the ink bag; an outflow port that is formed in a front surface of the housing, communicates with the ink bag, and causes the ink to flow out of the inside of the ink bag; a first detection window and a second detection window, which are formed in the housing; a plate that is fixed to an upper surface of the ink bag, and moves together with the ink bag in response to fluctuations of the amount of ink; an "empty" detecting member that is set movable following the plate in the housing, and moves to a position of closing the first detection window when the ink runs out; and a "full" detecting member that is set movable following the plate in the housing, and moves to a position of closing the second window when a fixed amount or more of the ink is stored in the ink bag.

In the ink cartridge according to the present invention, when the fixed amount or more of ink is stored in the ink bag, the "full" detecting member has moved to the position of closing the second detection window. Here, when the ink in the ink bag flows out of the outflow port, the ink bag is gradually deformed in response to the amount of ink remaining in the inside thereof, and a thickness thereof is started to be changed. Therefore, the plate fixed to the upper surface of the ink bag moves in response to a decrease of the amount of ink. Further, the "full" detecting member moves following this movement of the plate. Then, when the ink in the ink bag falls below the fixed amount, the "full" detecting member moves to a position of opening the second detection window.

Hence, the open/close state of the second detection window, which is made by the "full" detecting member, is detected, whereby it can be detected that the ink in the ink bag has the fixed amount or more.

Further, the "empty" detecting member also moves following the movement of the plate, which is caused by such outflow of the ink. Here, the "empty" detecting member is located at a position of opening the first detection window when the ink is present in the ink bag. Then, when the ink in the ink bag is consumed, and the ink runs out, the "empty" detecting member moves to the position of closing the first detection window.

Hence, the open/close state of the first detection window, which is made by the "empty" detecting member, is detected, whereby it can be detected that the ink in the ink bag runs out.

As described above, the open/close states of the first detection window and the second detection window are detected, whereby both of such detection that the fixed amount or more of ink is stored in the ink bag and such detection that the ink runs out therefrom (hereinafter, referred to as "full" detection and "empty" detection, respectively) can be performed simultaneously.

In particular, the ink bag is housed in the housing, and hence exchange of the ink bag just needs to be performed together with the housing, and exchange work thereof can be performed with ease. In addition, the first detection window and the second detection window can be accurately positioned with respect to an external detection unit, which detects the residual amount of ink, by using the housing, and accordingly, erroneous detection of the residual amount of ink can be prevented.

Further, in the ink cartridge of the present invention, it is preferred that the housing be mounted to be vertically placed while locating one side surface thereof downward, the first detection window be formed on the one side surface located downward, and the second detection window be formed on another side surface opposite to the one side surface.

In this case, the housing is mounted to be vertically placed while locating the one side surface downward. Accordingly, when the ink is caused to flow out of the ink bag, the ink is accumulated on the one side surface side as a lower side of the ink bag owing to the gravity. Specifically, when the ink starts to flow out of the ink bag, first, the another side surface side as an upper side of the ink bag squashes and becomes thinned in thickness. After that, when the ink further flows out of the ink bag, the one side surface side as the lower side of the ink bag squashes and gradually becomes thinned in thickness. Accordingly, as the thickness of the ink bag is being changed, the plate fixed to the ink bag first moves to the another side surface side, and thereafter moves to the one side surface side.

Hence, in particular when the residual amount of ink in the ink bag is a fixed amount or more, which is approximate to a full amount thereof, the open/close state of the second detection window formed on the another side surface side can be changed more accurately in response to the residual amount of ink.

Further, in particular when the residual amount of ink in the ink bag is small, the open/close state of the first detection window formed on the one side surface side can be changed more accurately in response to the residual amount of ink. Therefore, when the ink in the ink bag runs out, the "empty" detection can be made more accurately.

Further, in the ink cartridge of the present invention, it is preferred that the plate be fixed to a center portion of the ink bag in a longitudinal direction, the first detection window be formed at a substantial center of the one side surface in the longitudinal direction, and the second detection window be formed at a substantial center of the another side surface in the longitudinal direction.

In this case, the plate is fixed to the center portion of the upper surface of the ink bag. Accordingly, even if a thickness of an end portion of the ink bag in the longitudinal direction is extremely thinned locally, the movement of the plate is not largely affected by such a change of the thickness of the ink bag. Specifically, the plate moves accurately in matching with an entire change of the thickness of the ink bag without being misled by local fluctuation of the thickness of the ink bag. Therefore, both of the "empty" detecting member and the "full" detecting member, which move following the plate, can be moved more accurately, and the "full" detection and the "empty" detection can be performed more accurately.

Further, in the ink cartridge of the present invention, it is preferred that the "empty" detecting member include: a pin that is formed integrally with the plate, and protrudes toward the one side surface of the housing; a lever portion that is formed so as to extend unidirectionally from a proximal end side thereof to a tip end side thereof, in which the proximal end side is freely rotatably attached to the one side surface of the housing so as to slide on the one side surface; and a long-holed guide groove that is formed from the tip end side of the lever portion to the proximal end side thereof with a size to allow a tip end of the pin to be inserted therethrough, through which the pin is guided following the movement of the plate, and the lever portion move to the position of closing the first detection window when the ink runs out.

In this case, the tip end of the pin formed on the plate is inserted through the guide groove of the lever portion freely rotatably provided on the one side surface of the housing. Specifically, the plate and the lever portion are mechanically assembled to each other by mutual fitting of the pin and the guide groove. At this time, the ink bag is housed while facing a lower surface side thereof to a bottom surface side of the housing.

Here, the ink bag swells in a state where the fixed amount or more of ink is stored in the ink bag. Accordingly, the plate is spaced from the bottom surface of the housing. Further, the lever portion is stably supported on the pin through the guide groove in a state where the tip end side thereof is spaced from the bottom surface of the housing.

Next, when the ink is started to be consumed from the above-mentioned state, the ink bag is gradually deformed, and the thickness thereof is started to be changed. Therefore, the plate and the pin, which are fixed to the upper surface of the ink bag, also start to move gradually toward the bottom surface of the housing. Then, the lever portion is pulled by the pin inserted through the guide groove, and starts to rotate about the proximal end side of the lever portion itself. Specifically, the tip end side of the lever portion gradually rotates toward the bottom surface of the housing. Further, at this time, the lever portion slidingly moves while sliding on the one side surface of the housing.

Further, while the pin moves toward the bottom surface of the housing, the lever portion rotates about the proximal end side thereof. Accordingly, the pin moves from the tip end side of the lever-portion to the proximal end side thereof while being guided by the guide groove. Hence, the lever portion rotates while smoothly following the movement of the pin.

Then, when the ink is further consumed, and the ink in the ink bag runs out, the ink bag is deflated most, and accordingly, the plate and the pin approach the bottom surface of the housing most. Hence, in a similar way, the tip end side of the lever portion approaches the bottom surface most, and the lever portion stops rotating. At this time, the lever portion moves to the position of closing the first detection window.

Further, displacement of the ink bag can be converted into such a rotation operation of the lever portion, which slides on the one side surface of the housing, through the plate and the pin, that is, into linear movement of the ink bag in the thickness direction thereof. Accordingly, even if the ink bag makes three-dimensionally irregular motion, the lever portion itself slidingly moves while sliding on the one side surface without fail. Therefore, the lever portion can be actuated regularly without fail every time, and can be reliably moved to the position of closing the first detection window. Hence, the "empty" detection of the ink that is particularly important can be more reliably performed while preventing the erroneous detection.

Further, in the ink cartridge of the present invention, it is preferred that the housing be provided with a guide member that guides a rotation operation of the lever portion.

In this case, the guide member is provided on the housing, and hence the lever portion rotates in a more stable state and slidingly moves on the one side surface of the housing. Therefore, the "empty" detection of the ink can be more reliably performed while preventing the erroneous detection.

Further, in the ink cartridge of the present invention, it is preferred that the "full" detecting member include a protruding portion that is formed integrally with a side of the another side surface of the plate and is made to protrude from the plate to an opposite side with respect to the ink bag, and the protruding portion move to the position of closing the second detection window when the fixed amount or more of ink is stored in the ink bag.

In this case, the protruding portion is made to protrude on the opposite side with respect to the ink bag. Accordingly, even at the time when the ink in the ink bag is decreased and the thickness of the ink bag is thinned, the protruding portion does not contact the housing, and does not affect the movement of the plate and the "empty" detecting member. Hence, the "empty" detection of the ink can be performed more reliably while preventing the erroneous detection.

Further, in the ink cartridge of the present invention, it is preferred that the front surface of the housing include an inflow port formed therein, the inflow port communicating with the ink bag and causing the ink to flow into the inside of the ink bag.

In this case, on the front surface of the housing, the inflow port that communicates with the ink bag and causes the ink to flow into the ink bag is formed. Accordingly, the ink can be supplied from the inflow port into the ink bag. Therefore, when the ink in the ink bag runs out, and the first detection window is closed by the "empty" detecting member, the ink supply is started from the inflow port, and when the second detection window is closed by the "full" detecting member, the ink supply from the inflow port is stopped, whereby the ink can be always stored in the ink bag. Specifically, the ink cartridge can be made to function as a sub tank.

Further, in the ink cartridge of the present invention, it is preferred that the inflow port be formed at a position closer to the one side surface than to the another side surface between both the side surfaces of the housing.

In this case, on the front surface of the housing, the inflow port is formed at the position closer to the one side surface than to the another side surface. Specifically, the inflow port is formed on the lower side of the front surface of the housing. Hence, even if the ink rushes into the ink bag from the inflow port, and the thickness of the ink bag is temporarily changed along the longitudinal direction of the ink bag, such a change occurs on the lower side of the ink bag. Specifically, the thickness of the upper side of the ink bag is not changed, and the plate on the another side surface side does not move. Hence, the second detection window located on the another side surface side is not erroneously closed upon being affected by the deformation of the ink bag, which is caused by energy when the ink flows in as described above. Accordingly, the "full" detection of the ink can be performed more reliably while preventing the erroneous detection.

Further, in the ink cartridge of the present invention, it is preferred that the outflow port be formed above the inflow port.

In this case, the outflow port is formed above the inflow port. Accordingly, even if the air enters the ink bag through the inflow port from the outside, the air rises in the ink bag, and therefore, the air can be caused to flow out to the outside through the outflow port. Hence, the air can be made less likely to be accumulated in the ink bag. As a result, the change of the thickness of the ink bag can be suppressed from being affected by the air, and the residual amount of ink is reflected to the thickness of the ink bag more accurately, and accordingly, the residual amount of ink can be detected more accurately.

Further, a recording apparatus of the present invention is characterized by including: any one of the ink cartridges of the present invention; a detection unit that detects open/close states of the first detection window and the second detection window, and detects a residual amount of the ink stored in the ink bag based on a result of the detection; a recording head that ejects ink droplets on a recorded medium and performs recording thereon; an ink supply tube that is connected to the outflow port and supplies the ink from the ink cartridge to the recording head; a carriage portion that houses the recording head and slidingly moves the recording head on the recorded medium; and a recorded medium conveyor portion that conveys the recorded medium.

In the recording apparatus according to the present invention, the ink hermetically filled in the ink bag of the ink cartridge is appropriately supplied to the recording head from the ink supply tube connected to the outflow port. While being slidingly moved by the carriage portion on the recorded medium such as a recording sheet conveyed by the recorded sheet conveyor portion, this recording head ejects the ink droplets on the recorded medium, and performs the recording thereon. In such a way, the recording apparatus can appropriately record a variety of characters, diagrams, and the like on the recorded medium.

Further, the detection unit detects the open/close states of the detection windows of the ink cartridge, to thereby detect the residual amount of ink in the ink bag. Specifically, the detection unit can detect whether or not the residual amount of ink is the fixed amount or more based on the open/close state of the second detection window, and can detect whether or not the ink remains in the ink bag based on the open/close state of the first detection window.

In particular, the ink cartridge in which the erroneous detection of the residual amount of ink is prevented is provided. Accordingly, it can be accurately detected that the ink runs out. Therefore, the ink cartridge can be exchanged in a state where the ink is used with nothing wasted, and running cost of the recording apparatus itself can be suppressed. Hence, the recording apparatus is user-friendly and economical.

Further, in the recording apparatus of the present invention, it is preferred that the detection unit include: a first detection unit that applies detection light toward the first detection window and detects the open/close state of the first detection window based on whether or not reflection of the detection light occurs; and a second detection unit that applies detection light toward the second detection window and detects the open/close state of the second detection window based on whether or not reflection of the detection light occurs.

In this case, the open/close state of the first detection window can be detected by the first detection unit based on whether or not the reflection of the detection light applied toward the first detection window occurs, and the open/close state of the second detection window can be detected by the second detection unit based on whether or not the reflection of the detection light applied toward the second detection window occurs. Hence, the open/close states can be detected even if these detection units and the detection windows are not placed close to each other. Accordingly, the detection units can be placed at positions apart from the detection windows corresponding thereto. Therefore, a degree of freedom in designing the recording apparatus can be enhanced.

In accordance with the ink cartridge according to the present invention, the erroneous detection of the residual amount of ink can be prevented, and the exchange work of the ink cartridge itself can be facilitated.

Further, in accordance with the recording apparatus according to the present invention, the ink cartridge in which the erroneous detection of the residual amount of ink is prevented is provided. Accordingly, the ink cartridge can be exchanged in a state where the ink is used with nothing wasted, and running cost of the recording apparatus itself can be suppressed. Therefore, the recording apparatus is user-friendly and economical.

DETAILED DESCRIPTION OF THE PREFERRED EMBODIMENTS

Description is made below of an embodiment of a recording apparatus and an ink cartridge according to the present invention with reference to FIG. 1 to FIG. 11.

Figure 1:
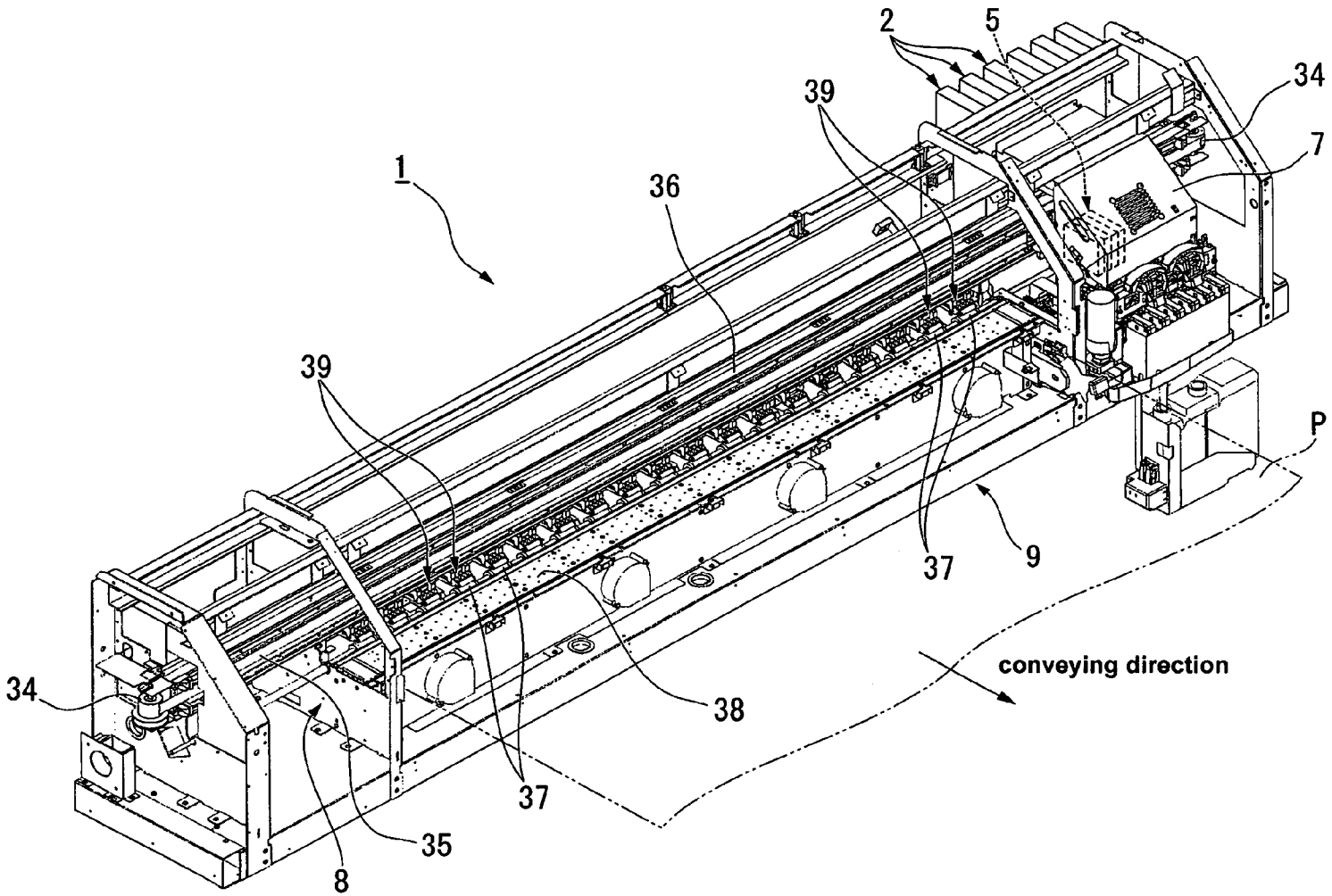
FIG. 1 is a schematic perspective view of an inkjet printer according to an embodiment of the present invention.
Figure 2:
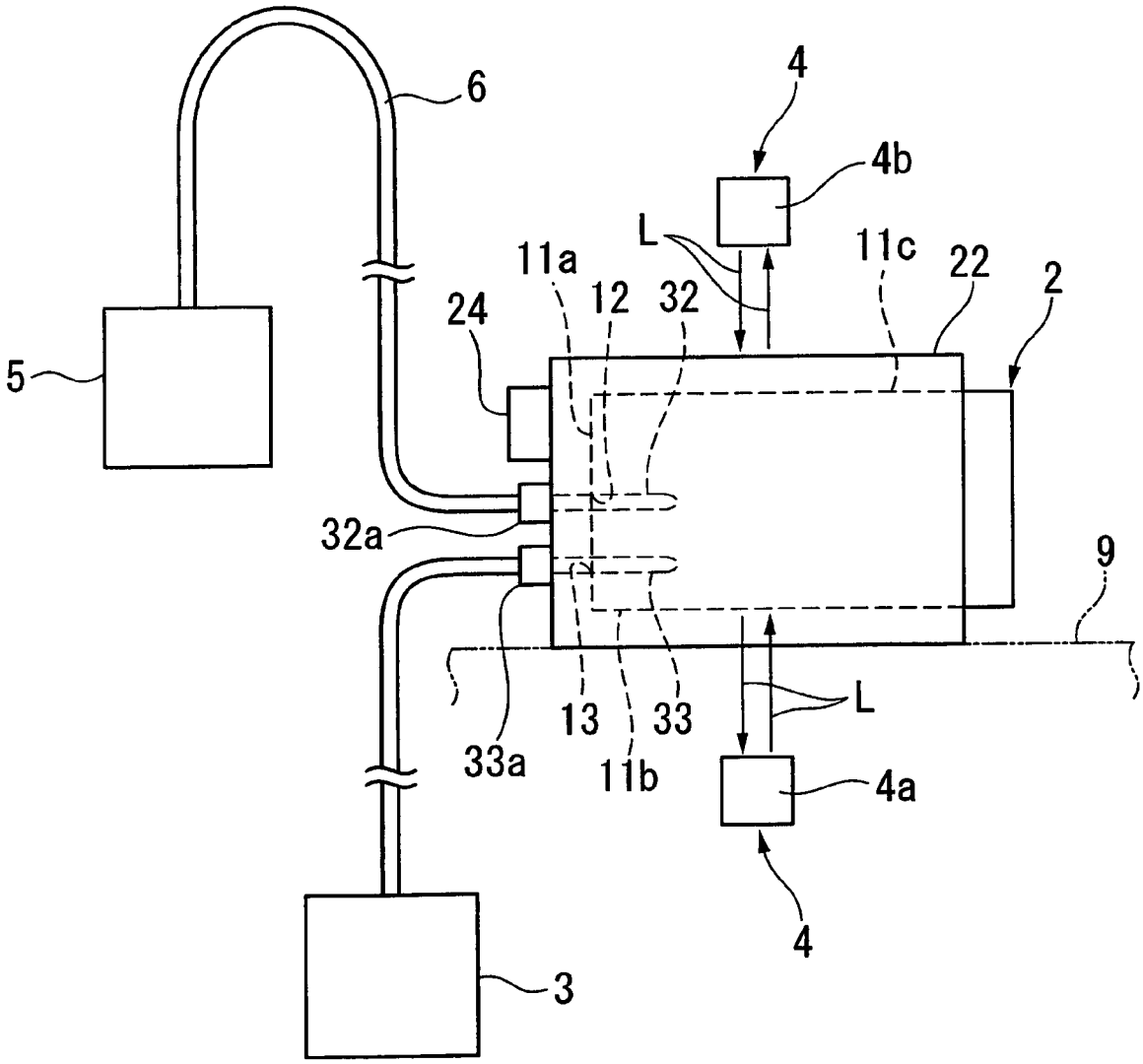
FIG. 2 is a schematic view illustrating an attached state of an ink cartridge constituting the inkjet printer illustrated in FIG. 1.

As illustrated in FIG. 1 and FIG. 2, an inkjet printer (recording apparatus) 1 of this embodiment includes: a plurality of ink cartridges 2 containing inks F of colors different from one another; main tanks 3, each of which is connected to each of the ink cartridges 2, and supplies each of the inks F to the ink cartridge 2; detection units 4, each of which detects a residual amount of the ink F stored in a pouch (ink bag) 10 of the ink cartridge 2 described later; recording heads 5, each of which ejects ink droplets on a recording sheet (recorded medium) P, and performs recording thereon; ink supply tubes 6, each of which supplies the ink F from the ink cartridge 2 to the recording head 5; a carriage portion 7 that houses the recording heads 5 and slidingly moves the recording heads 5 on the recording medium P; a recording sheet conveyor portion (recorded medium conveyor portion) 8 that conveys the recording sheet P; and a base 9 on which these respective constituents are installed.

Figure 3:
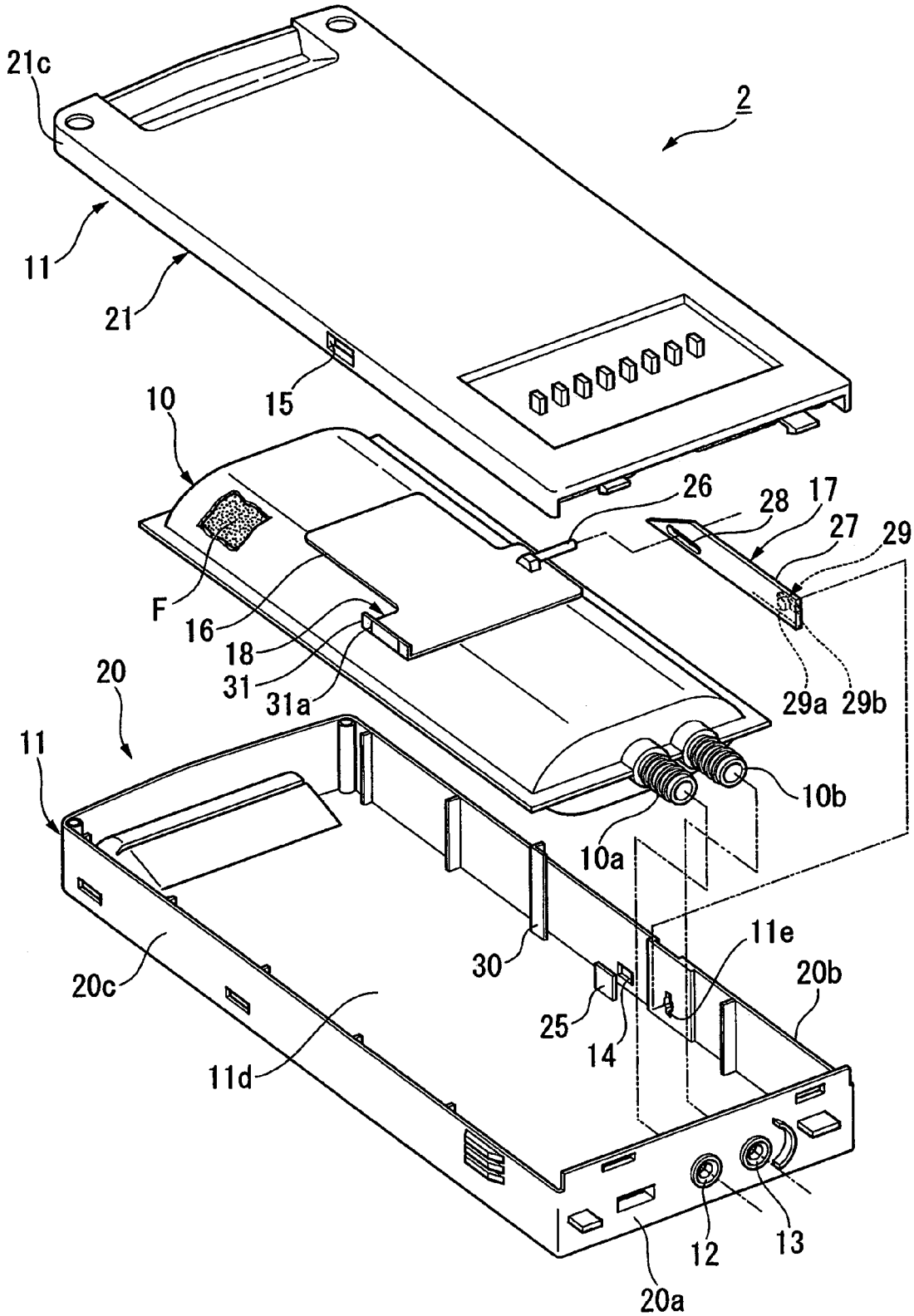
FIG. 3 is a schematic exploded perspective view of the ink cartridge illustrated in FIG. 2.

As illustrated in FIG. 3, the ink cartridge 2 includes: the flexible pouch 10, in an inside of which the ink F is stored, and which has a thickness changed in response to an amount of the ink; a case (housing) 11 that houses the pouch 10; an outflow port 12 that is formed on a front surface 11*a* of the case 11, communicates with the pouch 10, and causes the ink F to flow out of the inside of the pouch 10; an inflow port 13 that is formed on the front surface 11*a* of the case 11, communicates with the pouch 10, and causes the ink F to flow into the inside of the pouch 10; a first detection window 14 and a second detection window 15, which are formed on the case 11; a plate 16 that is fixed to an upper surface of the pouch 10, and moves together with the pouch 10 in response to fluctuations of the amount of ink; an "empty" detecting member 17 that is set movable following the plate 16 in the case 11, and moves to a position of closing the first detection window 14 when the ink F runs out; and a "full" detecting member 18 that is set movable following the plate 16 in the case 11, and moves to a position of closing the second detection window 15 when a fixed detection amount (fixed amount) or more of the ink F is stored in the pouch 10.

The pouch 10 is formed by superposing two aluminum laminated films on each other and bonding peripheral edge portions thereof to each other by thermal welding and the like. Here, each of the aluminum laminated films is formed, for example, by sandwiching an aluminum sheet between a nylon film located on an outside thereof and a polyethylene film located on an inside thereof.

Onto one end of the pouch 10, an ink outlet port 10*a* and an ink inlet port lob are bonded by the thermal welding and the like while being spaced from each other. Here, the ink outlet port 10*a* discharges, to an outside of the pouch 10, the ink F stored in the inside of the pouch 10, and the ink inlet port lob supplies the ink F into the pouch 10 from the outside of the pouch 10. Each of these ink outlet port 10*a* and ink inlet port 10*b* is formed of plastic or the like into a pipe shape, and on an outer circumferential surface thereof, a plurality of fixing grooves for attaching the ink outlet port 10*a* or the ink inlet port 10*b* to the case 11 are formed.

The case 11 is formed of a case body 20 and a cover portion 21, which are formed of plastic or the like into box shapes, and are set freely attachable to and detachable from each other by fastening members such as screws. In this embodiment, as illustrated in FIG. 2, the case 11 is mounted on a holder 22 in the inkjet printer 1 so as to be freely attachable thereto and detachable therefrom in a state where a longitudinal direction of the front surface 11*a* of the case 11 goes along the vertical direction, that is, in a state where the ink cartridge 2 is vertically placed. Note that, with regard to the ink cartridge 2 illustrated in FIG. 3, there is illustrated an exploded perspective view thereof in a state where the longitudinal direction of the front surface 11*a* of the case 11 goes along the horizontal direction, that is, in a state where the ink cartridge 2 is horizontally placed.

In the following, as illustrated in FIG. 2, a side surface of the case 11, which is located on a lower side when the case 11 is mounted on the holder 22, is referred to as one side surface 11*b*, and a side surface thereof located on an upper side when the case 11 is mounted on the holder 22 is referred to as another side surface 11*c*. Further, as illustrated in FIG. 3, one surface of the case body 20, which forms the front surface 11*a* of the case 11, is referred to as a front surface 20*a* of the case body 20, one surface of the case body 20, which forms the one side surface 11*b* of the case 11, is referred to as one side surface 20*b* of the case body 20, and one surface of the case body 20, which forms the another side surface 11*c* of the case 11, is referred to as another side surface 20*c* of the case body 20. Further, one surface of the cover portion 21, which forms the another side surface 11*c* of the case 11, is referred to as another side surface 21*c* of the cover portion 21.

As illustrated in FIG. 2 and FIG. 3, on the front surface 20*a* of the case body 20, the outflow port 12 and the inflow port 13 are provided.

In this embodiment, between both side surfaces 20*b* and 20*c* of the case body 20, the inflow port 13 is formed at a position closer to the one side surface 20*b* than to the another side surface 20*c*. Further, the outflow port 12 is formed at a substantial center in the longitudinal direction of the front surface 20*a* of the case body 20, and is located above the inflow port 13 when the ink cartridge 2 is vertically placed.

Figure 4:
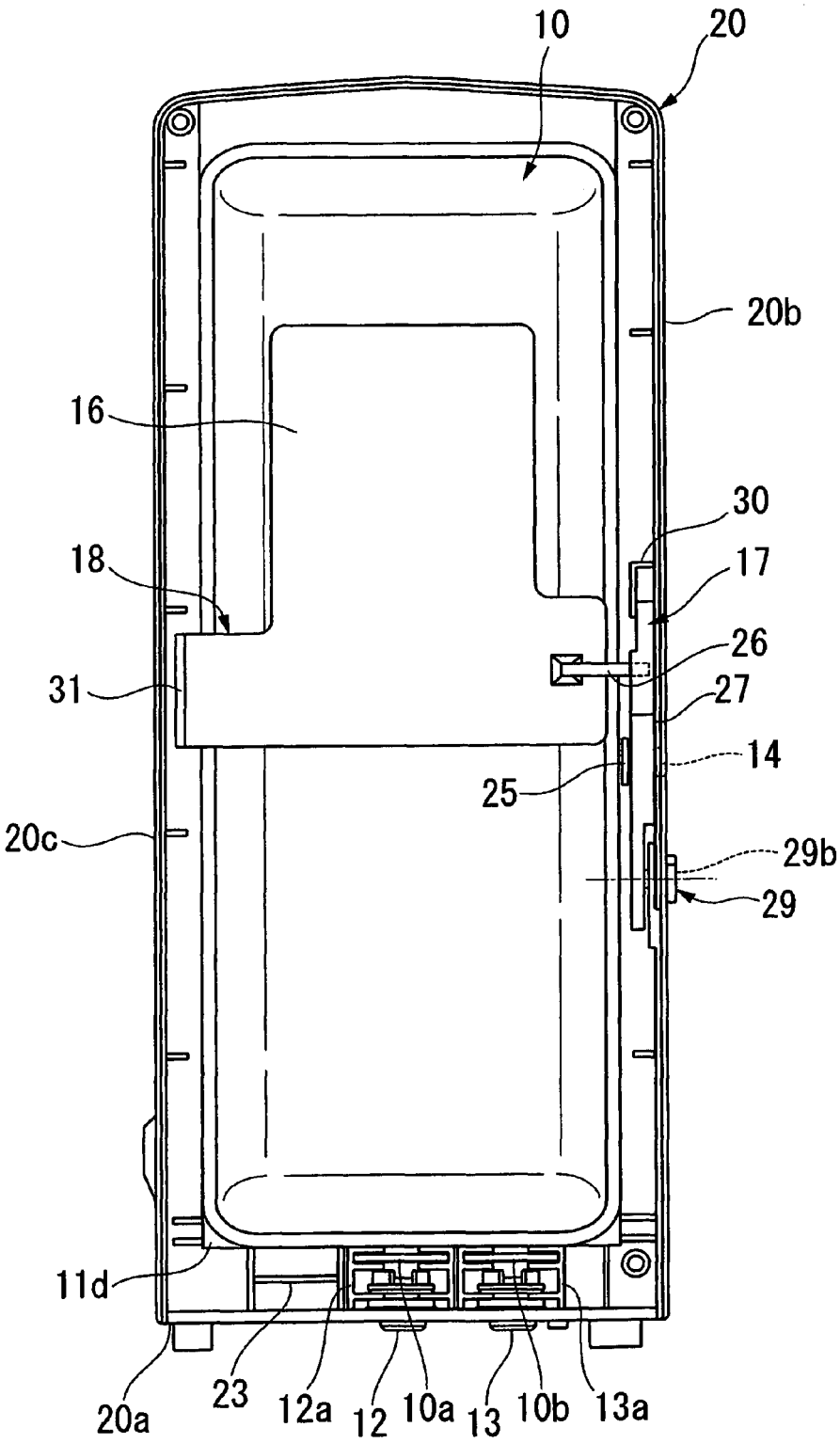
FIG. 4 is a schematic plan view at a time when a pouch illustrated in FIG. 3 is attached to a case body.

Further, as illustrated in FIG. 4, on a bottom surface 11*d* of the case body 20 in the vicinity of the outflow port 12, fitting grooves 12*a* to which the fixing grooves of the ink outlet port 10*a* of the pouch 10 are fitted are formed. The fixing grooves of the ink outlet port 10*a* are fitted to the fitting grooves 12*a*, whereby the pouch 10 is positioned and fixed to the case body 20 so that a first supply needle 32 to be described later can be inserted into the ink outlet port 10*a* when the ink cartridge 2 is mounted on the holder 22.

Further, on the bottom surface 11*d* of the case 11 in the vicinity of the inflow port 13, fitting grooves 13*a* to which the fixing grooves of the ink inlet port 10*b* of the pouch 10 are fitted are formed. The fixing grooves of the ink inlet port 10*b* are fitted to the fitting grooves 13*a*, whereby the pouch 10 is positioned and fixed to the case body 20 so that a second supply needle 33 to be described later can be inserted into the ink inlet port 10*b* when the ink cartridge 2 is mounted on the holder 22.

Then, the pouch 10 is fixed to the case body 20 formed as described above by adhesion or the like while facing a lower surface of the pouch 10 concerned to the bottom surface 11*d* side of the case 11.

Further, on the bottom surface 11*d* in the vicinity of the front surface 20*a* of the case body 20, an IC tag 23 is provided, in which information regarding the ink cartridge 2 (for example, color of the ink F, date of manufacture of the ink cartridge 2, and the like) is stored. When the ink cartridge 2 is mounted on the holder 22 as illustrated in FIG. 2, the information stored in the IC tag 23 is read by an IC reader 24 provided on the inkjet printer 1. In such a way, for example, when the ink cartridge 2 that stores ink of a different color from a preset color is mounted on the holder 22, such erroneous insertion of the ink cartridge 2 can be sensed.

As illustrated in FIG. 3 and FIG. 4, on the one side surface 20*b* of the case body 20, the first detection window 14 is formed. The first detection window 14 is formed at a substantial center in the longitudinal direction of the one side surface 20*b*.

Further, on the bottom surface 11*d* of the case body 20 in the vicinity of the first detection window 14, a flat reflective plate 25 is protruded. The reflective plate 25 is protruded substantially parallel to the one side surface 20*b*, and is provided at a position opposed to the first detection window 14 while being spaced from the one side surface 20*b*. Onto a surface of the reflective plate 25, which is opposed to the one side surface 20*b*, a reflective sheet (not shown) is pasted.

As illustrated in FIG. 3, on the another side surface 21*c* of the cover portion 21, the second detection window 15 is formed. The second detection window 15 is formed at a substantial center in the longitudinal direction of the another side surface 21*c*.

The plate 16 is formed of plastic or the like into a T shape when viewed from the above, and is fixed by adhesion or the like to a center portion of the upper surface of the pouch 10, the center portion being in the longitudinal direction of the pouch 10.

The "empty" detecting member 17 includes: a pin 26 that is formed integrally with the plate 16, and protrudes toward the one side surface 11*b* of the case 11; a lever portion 27 that is formed so as to extend unidirectionally from a proximal end side thereof to a tip end side thereof, in which the proximal end side is freely rotatably attached to the one side surface 11*b* of the case 11 so as to slide on the one side surface 11*b*; and a long-holed guide groove 28 that is formed from the tip end side of the lever portion 27 to the proximal end side thereof with a size to allow a tip end of the pin 26 to be inserted therethrough, through which the pin 26 is guided following the movement of the plate 16.

The pin 26 is formed on the one side surface 11*b* side of the plate 16, and has such a length that the tip end thereof reaches the vicinity of the one side surface 11*b* of the case 11.

The lever portion 27 is formed into a flat plate shape extending unidirectionally, and has a protruding portion 29 formed on a side surface thereof on the proximal end side. This protruding portion 29 is formed of a columnar shaft portion 29*a*, and a flat plate portion 29*b* extending in the same direction as that of the lever portion 27. Note that a length of the shaft portion 29*a* is a slightly longer than a thickness of the case body 20, and a center of the shaft portion 29*a* is a rotation center of the lever portion 27. Further, in the tip end of the lever portion 27, the above-mentioned guide groove 28 is formed. Further, onto a surface of the lever portion 27, which is opposed to the one side surface 11*b* of the case 11, a non-reflective sheet (not shown) is pasted.

Meanwhile, on the one side surface 20*b* of the case body 20, a through hole 11*e* which allows the protruding portion 29 to penetrate is formed in the vicinity of the first detection window 14. This through hole 11*e* is formed so that the flat plate portion 29*b* can pass therethrough in a state of facing to a thickness direction of the case body 20. Specifically, at the time of attaching the lever portion 27 to the case body 20, the protruding portion 29 can be inserted into the through hole 11*e* in a state of erecting the lever portion 27. Further, the lever portion 27 is rotated after such insertion, whereby the flat plate portion 29*b* abuts against an outer surface of the case body 20, and accordingly, the lever portion 27 does not fall off from the case body 20. Further, on the other hand, at the time of detaching the lever portion 27 from the case body 20, the lever portion 27 is rotated and erected, whereby it is made possible to pull out and detach the protruding portion 29 from the through hole 11*e*.

A fitting orientation between the protruding portion 29 and the through hole 11*e* is used as described above, whereby the lever portion 27 is freely attachable to and detachable from the case body 20.

Further, the lever portion 27 attached to the one side surface 11*b* of the case 11 is mechanically assembled to the plate 16 in such a manner that the pin 26 is inserted through the guide groove 28.

In the "empty" detecting member 17 formed as described above, as is described later, the lever portion 27 moves to the position of closing the first detection window 14 when the ink F in the pouch 10 runs out.

Further, on the bottom surface 11*d* of the case body 20, as illustrated in FIG. 3 and FIG. 4, an angle (guide member) 30 is provided, which is brought into surface contact with a side surface of the tip end side of the lever portion 27, and guides such a rotation operation of the lever portion 27.

The angle 30 is protruded from an inner surface of the one side surface 20*b* of the case body 20 in a direction orthogonal to this inner surface. Further, a tip end portion of the angle 30 is bent toward the proximal end side of the lever portion 27. Between the bent tip end portion of the angle 30 and the one side surface 20*b* of the case body 20, a gap into which the tip end side of the lever portion 27 is insertable is ensured.

The "full" detecting member 18 includes a protruding portion 31 that is formed integrally with the plate 16 on the another side surface 11*c* side thereof and is protruded from the plate 16 to an opposite side to the pouch 10. In this embodiment, the protruding portion 31 is formed in such a manner that an end portion of the plate 16 on the another side surface 11*c* side is bent so as to be parallel to the another side surface 11*c*. Onto a surface of the protruding portion 31, which is opposed to the another side surface 11*c*, a reflective sheet 31*a* is pasted.

In the "full" detecting member 18 formed as described above, as is described later, the protruding portion 31 moves to the position of closing the second detection window 15 when the detection amount or more of the ink F is stored in the pouch 10. Note that the detection amount of this embodiment is set at a value substantially equal to a full amount of the pouch 10.

Then, as illustrated in FIG. 2, the ink cartridge 2 formed as described above is mounted on the holder 22, and is thereby positioned with respect to the detection unit 4, to the first supply needle 32 that penetrates the ink outlet port 10*a* through the outflow port 12 and reaches the inside of the pouch 10, and to the second supply needle 33 that penetrates the ink inlet port 10*b* through the inflow port 13 and reaches the inside of the pouch 10.

The detection unit 4 includes: a first detection unit 4*a* that applies detection light L toward the first detection window 14 and detects an open/close state of the first detection window 14 based on whether or not reflection of the detection light L occurs; and a second detection unit 4*b* that applies the detection light L toward the second detection window 15 and detects an open/close state of the second detection window 15 based on whether or not the reflection of the detection light L occurs.

Here, the detection light L applied by the first detection unit 4*a* is not reflected because the detection light L is applied onto the non-reflective sheet of the lever portion 27 when the first detection window 14 is closed by the lever portion 27. Meanwhile, the detection light L is reflected because the detection light L is applied onto the reflective sheet of the reflective plate 25 when the first detection window 14 is opened without being closed by the lever portion 27. In such a way, the first detection unit 4*a* detects the open/close state of the first detection window 14, which is made by the lever portion 27, based on whether or not the reflection of the detection light L occurs.

Further, the detection light L applied by the second detection unit 4*b* is reflected because the detection light L is applied onto the reflective sheet 31*a* of the protruding portion 31 when the second detection window 15 is closed by the protruding portion 31. Meanwhile, the detection light L is not reflected because the detection light L just passes through the second detection window 15 when the second detection window 15 is opened without being closed by the protruding portion 31. In such a way, the second detection unit 4*b* detects the open/close state of the second detection window 15, which is made by the protruding portion 31, based on whether or not the reflection of the detection light L occurs.

As described above, in the detection unit 4 of this embodiment, both the first detection unit 4*a* and the second detection unit 4*b* can detect the open/close states of the corresponding detection windows based on whether or not the reflection of the detection light L occurs. Hence, the detection unit 4 can detect the open/close states even if the detection unit 4 is not placed close to the corresponding detection windows 14 and 15. Accordingly, the detection unit 4 can be placed, at positions apart from the holder 22. Therefore, a degree of freedom in designing the detection unit 4 can be enhanced.

The first supply needle 32 is connected to the ink supply tube 6 through a filter 32*a* that filters minute foreign particles in the ink F.

The ink supply tube 6 is formed, for example, of a flexible tube, and is adjusted to such a length that does not affect the recording head 5 slidingly moving together with the carriage portion 7.

The second supply needle 33 is connected to the main tank 3 through a filter 33*a* that filters the minute foreign objects in the ink F and through a tube.

The main tank 3 is an ink container in which the ink F is hermetically filled in advance. In the inkjet printer 1, the plurality of main tanks 3 are provided freely detachably so as to correspond to the color types of the ink cartridges 2. A control unit (not shown) is electrically connected to each of the main tanks 3, and the control unit allows the ink F, which is filled in the main tank 3, to be fed out to the ink cartridge 2 based on a detection result of the open/close states of the detection windows 14 and 15 by the detection unit 4.

As illustrated in FIG. 1, the carriage portion 7 is coupled to a conveyor belt 35 wound around a pair of pulleys 34. The pair of pulleys 34 rotate upon receiving rotational drive force from a motor (not shown). Further, on the base 9, a guide rail 36 that guides the sliding movement of the carriage portion 7 is provided. These guide rail 36 and conveyor belt 35 are provided on the base 9 so as to extend in a direction orthogonal to a direction in which the recording sheet P is conveyed. In such a way, the carriage portion 7 slidingly moves in the direction orthogonal to such a conveying direction of the recording sheet P.

The recording sheet conveyor portion 8 includes: conveyor rollers 37 which convey the recording sheet P; a platen 38 that supports the recording sheet P; and pressing members 39 which press the recording sheet P on the conveyor rollers 37. The platen 38 is provided on the base 9 so as to extend in the direction orthogonal to the direction in which the recording sheet P is conveyed in a similar way to the moving direction of the carriage portion 7.

Next, description is made below of the case of recording a character, a diagram and the like on the recording sheet P by using the inkjet printer 1 formed as described above.

Figure 5:
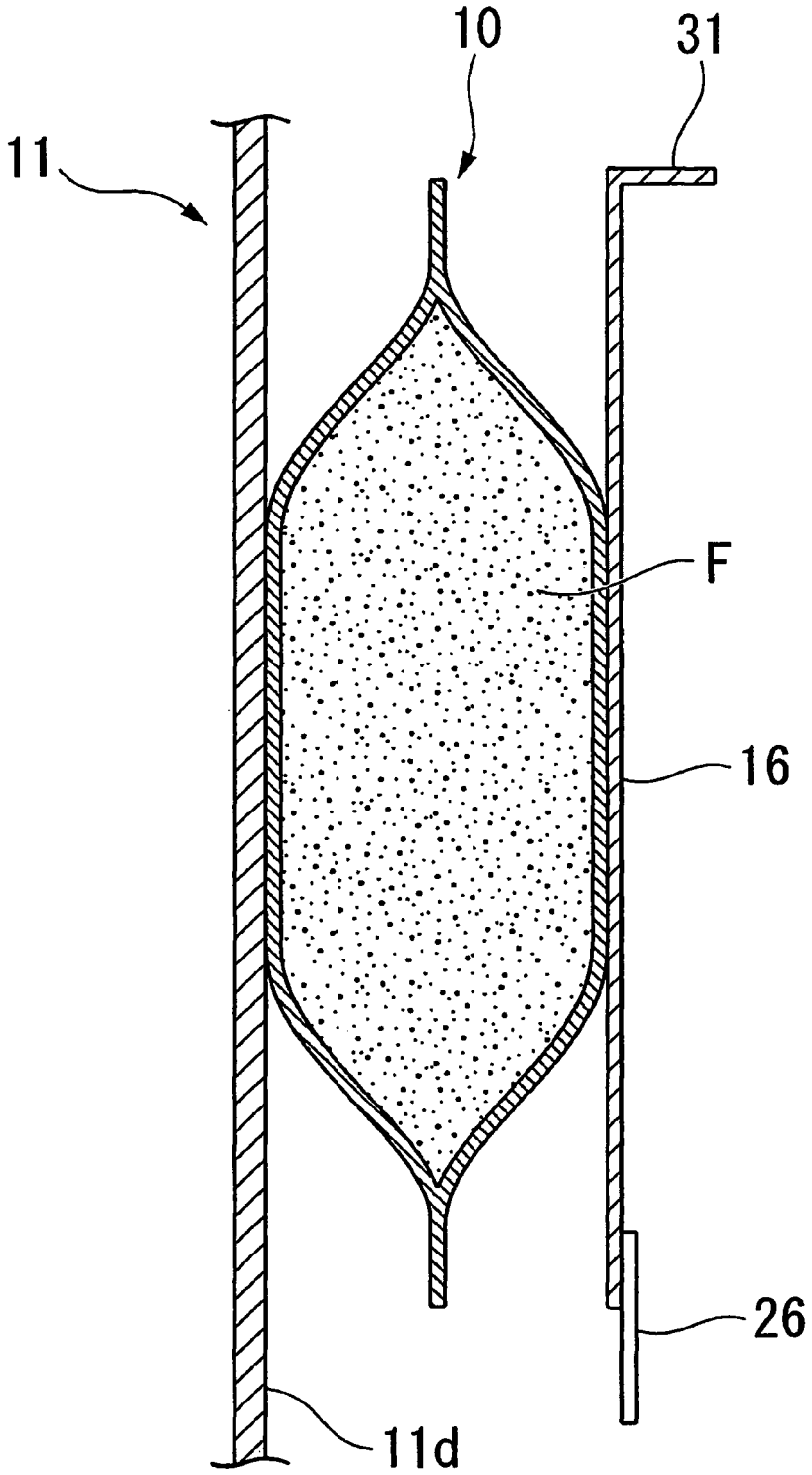
FIG. 5 is a schematic cross-sectional view of the ink cartridge that houses the pouch in which ink of a detection amount or more is stored.
Figure 6:
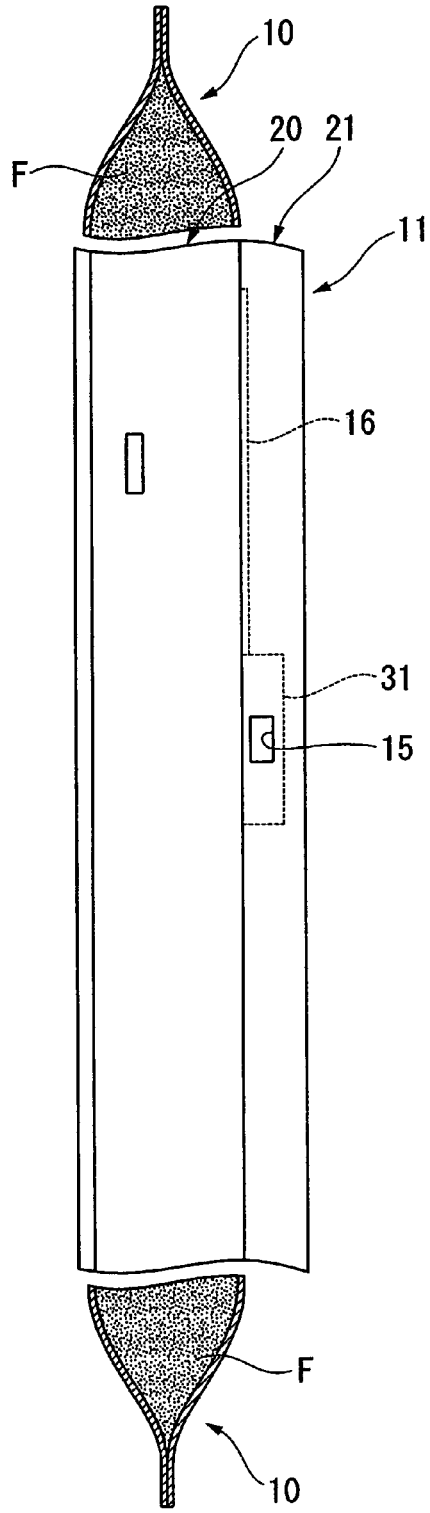
FIG. 6 is a schematic side view of the ink cartridge illustrated in FIG. 5 when viewed from another side surface thereof.
Figure 7:
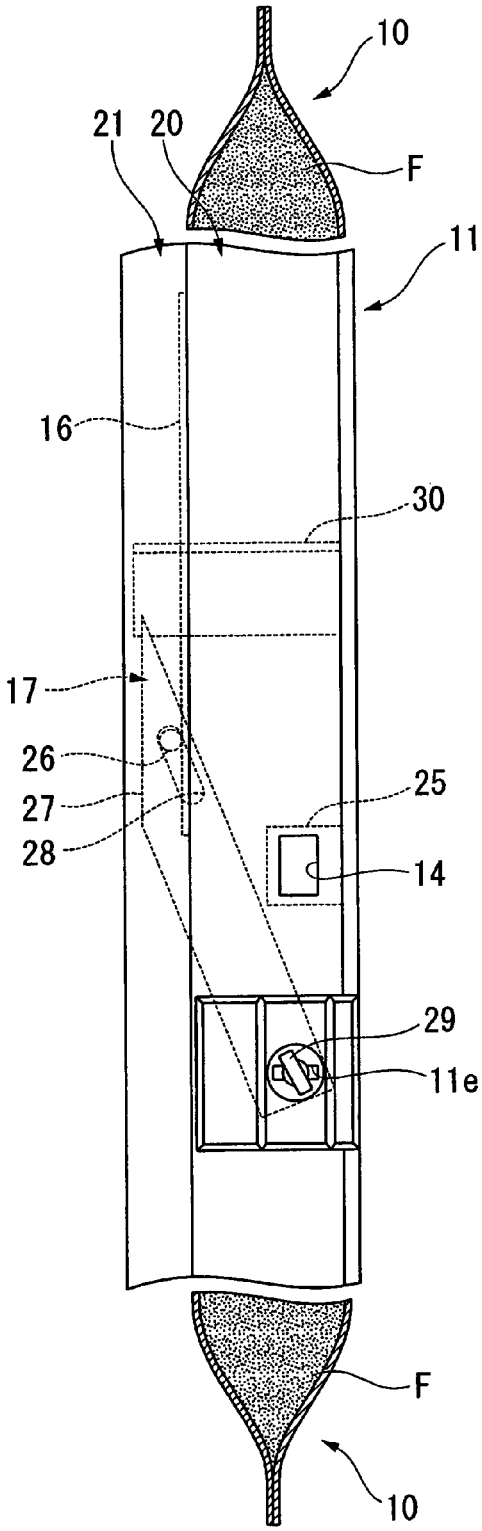
FIG. 7 is a schematic side view of the ink cartridge illustrated in FIG. 5 when viewed from one side surface thereof.

Note that, as illustrated in FIG. 5, FIG. 6 and FIG. 7, with regard to the ink cartridge 2, it is assumed that the detection amount or more of the ink F is stored in the pouch 10, that the protruding portion 31 is located at the position of closing the second detection window 15, and that the lever portion 27 is located at the position of opening the first detection window 14.

When the inkjet printer 1 is operated, the inks F in the pouches 10 pass from the outflow ports 12 through the filters 32*a*, and are supplied to the recording heads 5 by the ink supply tubes 6. At the same time, the carriage portion 7 that houses the recording heads 5 slidingly moves in the direction orthogonal to the conveying direction of the recording sheet P by the conveyor belt 35 while being guided by the guide rail 36. Then, while the carriage portion 7 is moving slidingly, the recording heads 5 eject the ink droplets from the supplied inks F to the recording sheet P, and record the character, the diagram and the like thereon. Further, simultaneously with such recording, the recording sheet conveyor portion 8 conveys the recording sheet P little by little.

As a result, various types of information can be appropriately recorded on predetermined positions of the recording sheet P.

Figure 8:
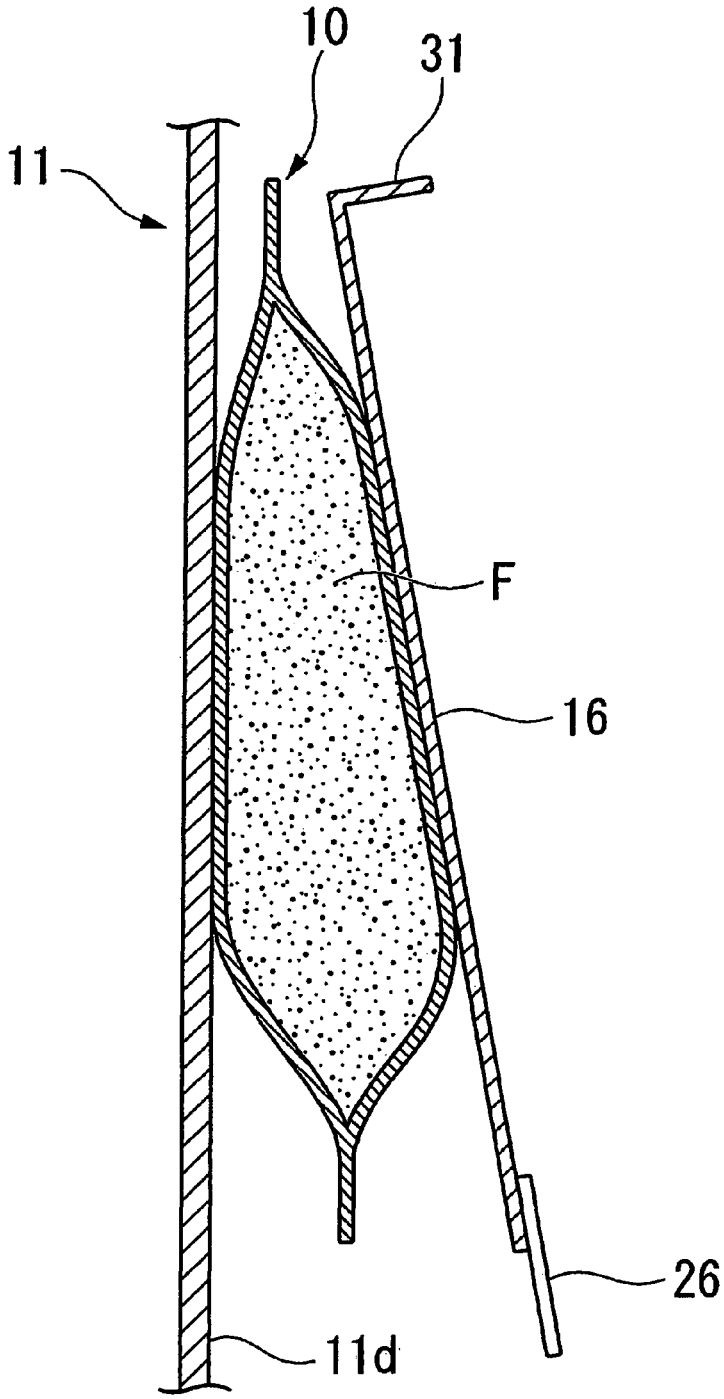
FIG. 8 is a schematic cross-sectional view of the ink cartridge from which the ink is consumed from a state illustrated in FIG. 5.

When the ink F in each of the pouches 10 is started to be consumed by performing such recording, the ink F is accumulated on the one side surface 11*b* side as the lower side of the pouch 10 owing to the gravity since the case 11 is mounted to be vertically placed while locating the one side surface 11*b* downward. Specifically, as illustrated in FIG. 8, when the ink F starts to flow out of the pouch 10, first, the another side surface 11*c* side as the upper side of the pouch 10 squashes and becomes thinned in thickness. After that, when the ink F further flows out of the pouch 10, the one side surface 11*b* side as the lower side of the pouch 10 squashes and gradually becomes thinned in thickness. Accordingly, as the thickness of the pouch 10 is being changed, in the plate 16 fixed to the pouch 10, the another side surface 11*c* side thereof first moves, and thereafter the one side surface 11*b* side thereof moves.

Figure 9:
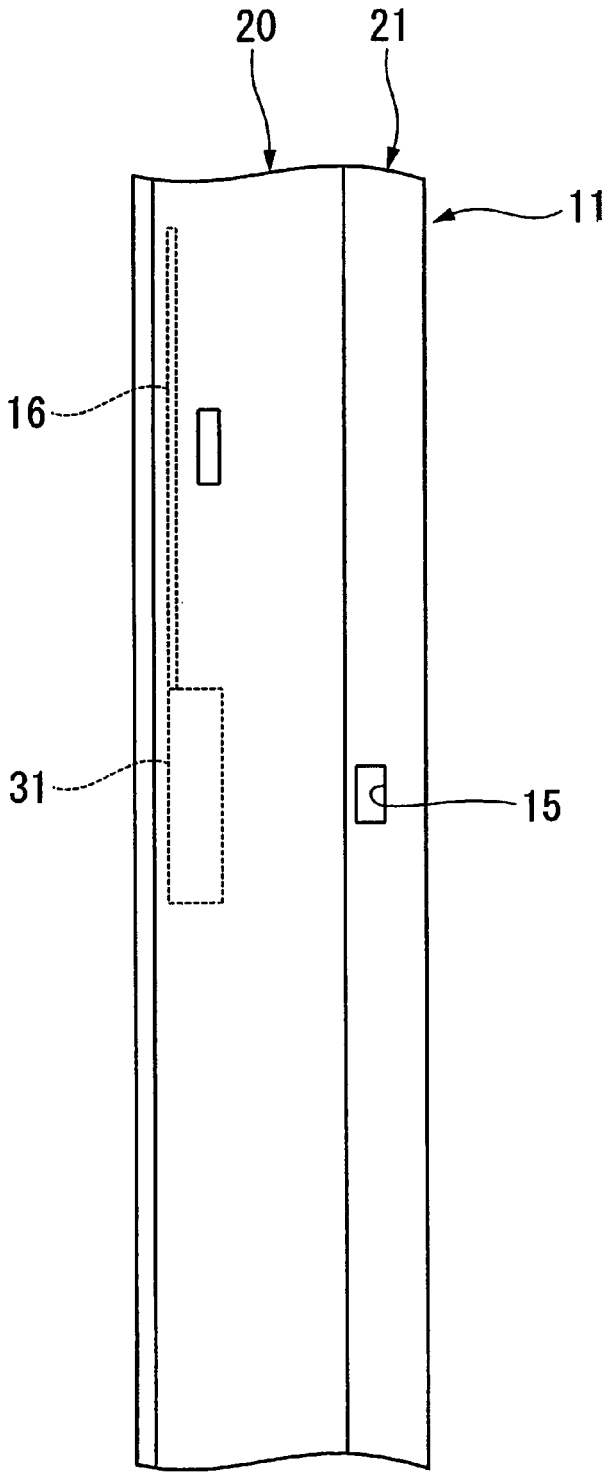
FIG. 9 is a schematic side view of the ink cartridge illustrated in FIG. 8 when viewed from the another side surface thereof.

Following such movement of the plate 16, first, the protruding portion 31 formed on the another side surface 11*c* side moves. Then, when the ink F in the pouch 10 falls down below the detection amount, the protruding portion 31 moves to the position of opening the second detection window 15 as illustrated in FIG. 8 and FIG. 9.

Hence, the open/close state of the second detection window 15, which is made by the protruding portion 31, is detected by the detection unit 4, whereby it can be detected that the ink F in the pouch 10 has the detection amount or more. In addition, the second detection window 15 is formed on the another side surface 11*c* side as the upper side, and accordingly, in particular when the residual amount of ink in the pouch 10 is a fixed amount or more, which is approximate to the full amount thereof, the residual amount of the ink F can be detected more accurately. Therefore, "full" detection can be made accurately.

Further, with regard to the pin 26 formed on the one side surface 11*b* side, as illustrated in FIG. 8, the one side surface 11*b* side of the plate 16 is spaced from the bottom surface 11*d* of the case 11 since the one side surface 11*b* side of the pouch 10 swells in a state where the ink F is reserved in the pouch 10. Further, the lever portion 27 is stably supported on the pin 26 through the guide groove 28 in a state where the tip end side thereof is spaced from the bottom surface 11*d* of the case 11.

After that, when the ink F is further consumed, the one side surface 11*b* side of the pouch 10 is gradually deformed, and the thickness thereof is started to be changed. Therefore, the plate 16 and the pin 26 on the one side surface 11*b* side, which are fixed to the upper surface of the pouch 10, start to move gradually toward the bottom surface 11*d* of the case 11. Then, the lever portion 27 is pulled by the pin 26 inserted through the guide groove 28, and starts to rotate about the proximal end side of the lever portion 27 itself. Specifically, the tip end side of the lever portion 27 gradually rotates toward the bottom surface 11*d* of the case 11. Further, at this time, the lever portion 27 slidingly moves while sliding on the one side surface 11*b* of the case 11.

Further, while the pin 26 moves toward the bottom surface 11*d* of the case 11, the lever portion 27 rotates about the proximal end side thereof. Accordingly, the pin 26 moves from the tip end side of the lever portion 27 to the proximal end side thereof while being guided by the guide groove 28. Hence, the lever portion 27 rotates while smoothly following the movement of the pin 26.

Figure 10:
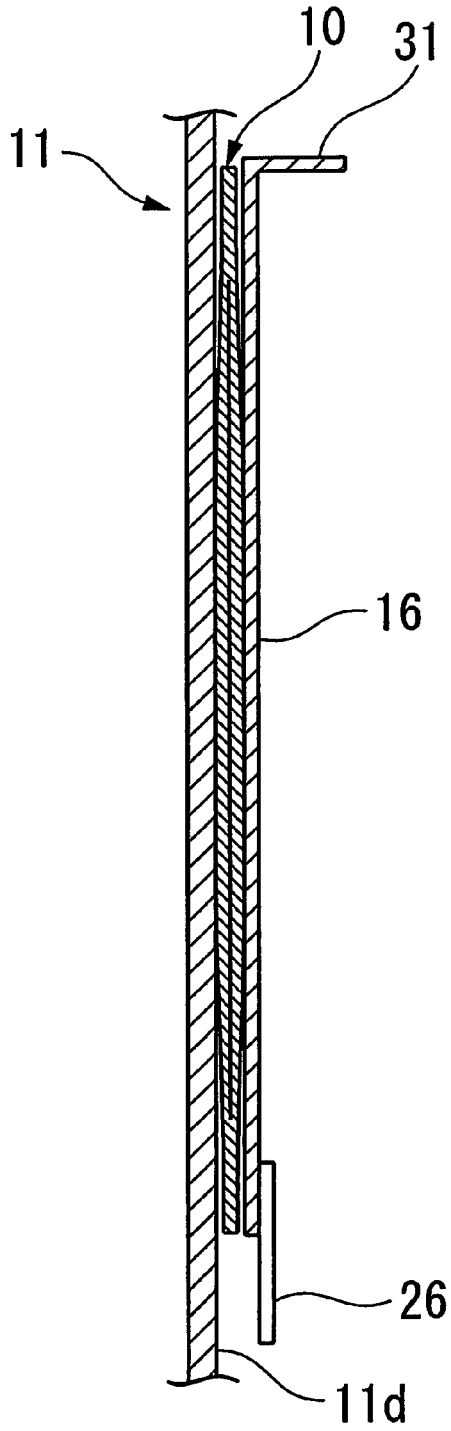
FIG. 10 is a schematic cross-sectional view of the ink cartridge from which the ink runs out after being consumed from a state illustrated in FIG. 8.
Figure 11:
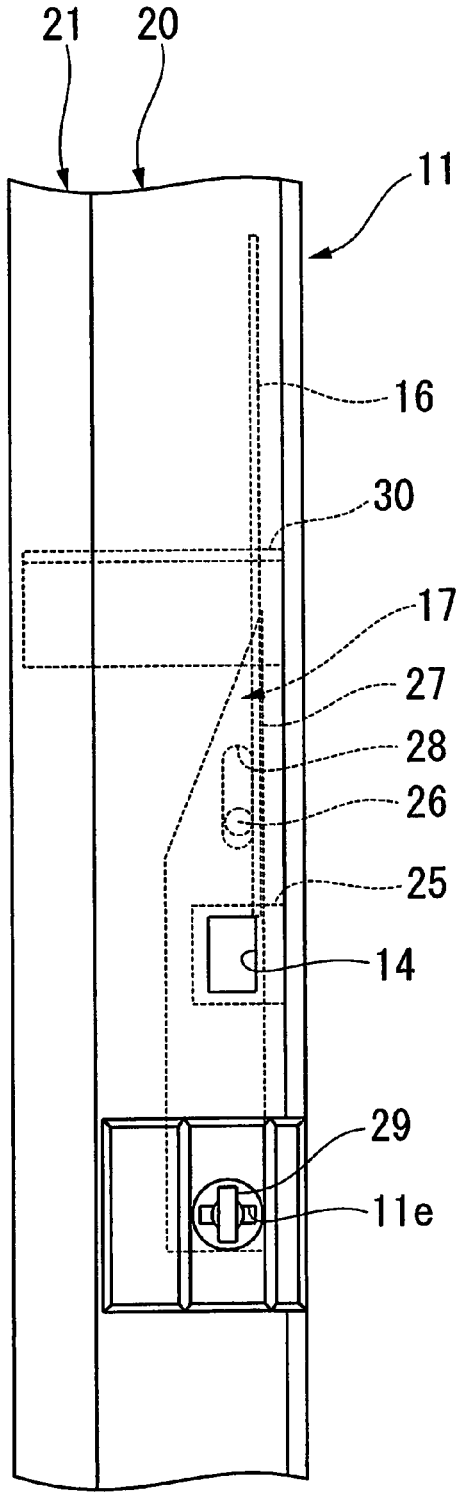
FIG. 11 is a schematic side view of the ink cartridge illustrated in FIG. 10 when viewed from the one side surface thereof.

Then, when the ink F is further consumed, and the ink F in the pouch 10 runs out, the pouch 10 is deflated most as illustrated in FIG. 10 and FIG. 11, and accordingly, the plate 16 and the pin 26 approach the bottom surface 11*d* of the case 11 most. Hence, in a similar way, the tip end side of the lever portion 27 approaches the bottom surface 11*d* most, and the lever portion 27 stops rotating. At this time, the lever portion 27 moves to the position of closing the first detection window 14.

Hence, the open/close state of the first detection window 14, which is made by the lever portion 27, is detected, whereby it can be detected that the ink F in the pouch 10 runs out. In addition, the first detection window 14 is formed on the one side surface 11*b* side as the lower side, and accordingly, in particular when the residual amount of ink in the pouch 10 is small, the residual amount of the ink F can be detected more accurately. Therefore, when the ink F in the pouch 10 runs out, the "empty" detection can be made accurately.

Next, description is made of the case of causing the ink F to flow into the pouch 10.

As described above, the "empty" detection is made when the ink F in the pouch 10 runs out. Accordingly, the ink F is caused to flow by the control unit into the pouch 10 from the main tank 3 through the inflow port 13, and the ink supply to the pouch 10 is started.

Then, as illustrated in FIG. 8, the ink F is accumulated on the one side surface 11*b* side as the lower side of the pouch 10, whereby the lower side of the pouch 10 thickens. After that, when the ink F is further caused to flow into the pouch 10, the another side surface 11*c* side as the upper side swells and thickens as illustrated in FIG. 5. Therefore, the protruding portion 31 moves to the position of closing the second detection window 15 as illustrated in FIG. 6, and accordingly, the "full" detection can be made.

Then, the inflow of the ink F to the pouch 10 is stopped based on this "full" detection, whereby such a state where the ink F is always stored in the pouch 10 can be maintained. Specifically, the ink cartridge 2 can be made to function as a sub tank.

In particular, since the pouch 10 is housed in the case 11, the exchange of the pouch 10 just needs to be performed together with the case 11, and exchange work thereof can be performed with ease. In addition, the first detection window 14 and the second detection window 15 can be accurately positioned with respect to the detection unit 4 by using the case 11, and accordingly, the erroneous detection of the residual amount of the ink F can be prevented.

Further, displacement of the pouch 10 can be converted into the rotation operation of the lever portion 27, which slides on the one side surface 11*b*, through the plate 16 and the pin 26, that is, into linear movement of the pouch 10 in the thickness direction therethrough. Accordingly, even if the pouch 10 makes three-dimensionally irregular motion, the lever portion 27 itself slidingly moves while sliding on the one side surface 11*b* without fail. Therefore, the lever portion 27 can be actuated regularly without fail every time, and can be reliably moved to the position of closing the first detection window 14. Hence, the "empty" detection that is particularly important can be reliably performed while preventing the erroneous detection.

Further, since the angle 30 is provided on the case 11, the lever portion 27 rotates in a more stable state and slidingly moves on the one side surface 11*b* of the case 11. Therefore, the "empty" detection of the ink F can be reliably performed while preventing the erroneous detection.

Further, the protruding portion 31 is protruded on the opposite side with the pouch 10. Accordingly, even at the time when the ink F in the pouch 10 is decreased, and the thickness of the pouch 10 is thinned, the protruding portion 31 does not contact the bottom surface 11*d* of the case 11, and does not affect the movement of the plate 16 and the "empty" detecting member 17. Hence, the "empty" detection of the ink F can be performed more reliably while preventing the erroneous detection.

Further, the plate 16 is fixed to the center portion of the upper surface of the pouch 10. Accordingly, even if the thickness of the end portion of the pouch 10 in the longitudinal direction is extremely thinned locally, the movement of the plate 16 is not largely affected by such a change of the thickness of the pouch 10. Specifically, the plate 16 moves accurately in matching with an entire change of the thickness of the pouch 10 without being misled by local fluctuation of the thickness of the pouch 10. Therefore, both of the "empty" detecting member 17 and the "full" detecting member 18, which move following the plate 16, can be moved more accurately, and the "full" detection and the "empty" detection can be performed more accurately.

Further, on the front surface 20*a* of the case body 20, the inflow port 13 is formed at a position closer to the one side surface 11*b* than to the another side surface 11*c*. Specifically, the inflow port 13 is formed on the lower side of the front surface 20*a* of the case body 20. Hence, even if the ink F rushes into the pouch 10 from the inflow port 13, and the thickness of the pouch 10 is temporarily changed along the longitudinal direction of the pouch 10, such a change occurs on the lower side of the pouch 10. Specifically, the thickness of the upper side of the pouch 10 is not changed, and the plate 16 on the another side surface 11*c* side does not move. Hence, the second detection window 15 located on the another side surface 11*c* side is not erroneously closed upon being affected by the deformation of the pouch 10, which is caused by energy when the ink F flows in as described above. Accordingly, the "full" detection of the ink F can be performed more reliably while preventing the erroneous detection.

Further, the outflow port 12 is formed above the inflow port 13. Accordingly, even if the air enters the pouch 10 through the inflow port 13 from the outside, the air rises in the pouch 10, and therefore, the air can be flown out to the outside through the outflow port 12. Hence, the air can be made less likely to be accumulated in the pouch 10. As a result, the change of the thickness of the pouch 10 can be suppressed from being affected by the air, and the residual amount of ink is reflected to the thickness of the pouch 10 more accurately, and accordingly, the residual amount of ink can be detected more accurately.

Further, the ink cartridge 2 in which the erroneous detection of the residual amount of the ink F is prevented is provided. Accordingly, it can be accurately detected that the ink F runs out. Therefore, the ink cartridge 2 can be exchanged in a state where the ink F is used with nothing wasted, and running cost of the recording apparatus can be saved. Hence, the recording apparatus is user-friendly and economical.

Note that the technical scope of the present invention is not limited to the above-mentioned embodiment, and it is possible to add a variety of alterations to the present invention within the range without departing from the gist of the present invention.

For example, in the above-mentioned embodiment, the ink cartridge 2 is mounted on the holder 22 in the state of being vertically placed while locating the one side surface 11*b* downward. However, the ink cartridge 2 may be mounted thereon to be horizontally placed. Further, in the case where the ink cartridge 2 is mounted to be horizontally placed, the first detection window 14 and the second detection window 15 do not have to be formed on the side surfaces opposite to each other, and for example, may be formed on the same side surface.

Further, in the above-mentioned embodiment, both of the first detection window 14 and the second detection window 15 are formed on the substantial centers in the longitudinal direction of the side surfaces 11*b* and 11*c* of the case 11. However, for example, the first detection window 14 and the second detection window 15 may be formed on end sides in the longitudinal direction of the side surfaces 11*b* and 11*c*.

Further, the "empty" detecting member 17 and the "full" detecting member 18 are not limited to device constructions illustrated in the above-mentioned embodiment. For example, the device construction of the "empty" detecting member 17, which is illustrated in the above-mentioned embodiment, may be used as a device construction of a "full" detecting member, and the device construction of the "full" detecting member 18, which is illustrated in the above-mentioned embodiment, may be used as a device construction of an "empty" detecting member.

Further, though the angle 30 is provided on the case 11 in the above-mentioned embodiment, the angle 30 may be eliminated.

Further, in the above-mentioned embodiment, the protruding portion 31 is formed by bending the end portion of the plate 16. However, for example, a flat member or the like may be formed integrally with the plate 16 by being bonded to the plate 16.

Further, though the inflow port 13 is formed on the case 11 in the above-mentioned embodiment, the inflow port 13 may be eliminated. In this case, the ink cartridge 2 can be used not as the sub tank supplied with the ink F from the main tank 3, but, for example, as an ink container of a throwaway type, which is exchanged when the ink F filled in the pouch 10 is finished being consumed.

Further, in the case where the ink cartridge 2 is not used as the sub tank, the main tank 3 may be eliminated from the inkjet printer 1.

Further, in the above-mentioned embodiment, on the front surface 11*a* of the case 11, the outflow port 13 is formed at the position closer to the one side surface 11*b* than to the another side surface 11*c*. However, the outflow port 13 may be formed at a position closer to the another side surface 11*c*.

Further, in the above-mentioned embodiment, the inflow port 12 is provided so as to be located on the upper side when the ink cartridge 2 is vertically placed. However, for example, the inflow port 13 may be provided at a position above the outflow port 12.

Further, in the above-mentioned embodiment, the detection unit 4 detects the open/close states of the detection windows 14 and 15 based on whether or not the reflection of the detection light L occurs. However, the detection unit 4 may image the detection windows 14 and 15, and perform image processing for images taken thereby, and thereby may detect the open/close states.

Further, in the above-mentioned embodiment, the detection amount is set at the amount substantially equal to the full amount of the pouch 10. However, for example, the detection amount may be set at an approximate half of a capacity of the pouch 10. In this case, the second detection window 15 may be formed, for example, on the another side surface 20*c* of the case body 20.

Besides the above, it is possible to appropriately replace the constituents in the above-mentioned embodiment by known constituents within the range without departing from the gist of the present invention. Further, such modification examples as described above may be appropriately combined with one another.

What is claimed is:

1. An ink cartridge, comprising:

a flexible ink bag configured to store ink and change in thickness thereof according to an amount of the ink;

a housing having a front surface, a first side surface and a second side surface opposite the first side surface, the housing being configured to accommodate the ink bag and to be mounted vertically with the first side surface projecting downward;

an inflow port formed in the front surface of the housing and in fluid communication with the inside of the ink bag to allow ink to flow into the ink bag, the inflow port being disposed between the first and second side surfaces of the housing at a position closer to the first side surface than to the second side surface;

an outflow port formed in the front surface of the housing and in fluid communication with the inside of the ink bag to allow the ink to flow out of the inside of the ink bag, the outflow port being disposed between the first and second side surfaces of the housing at a position above the inflow port when the housing is mounted vertically;

a first detection window formed on the first side surface of the housing;

a second detection window formed on the second side surface of the housing;

a plate that is fixed to an upper surface of the ink bag and that moves together with the ink bag within the housing in response to fluctuations in the amount of ink in the ink bag;

a first detecting member that detects an empty state of the ink bag and that is mounted to undergo movement following movement of the plate within the housing and to undergo movement to a position of closing the first detection window when the ink runs out and the ink bag is in the empty state, the first detecting member having a pin formed integrally with the plate and protruding toward the first side surface of the housing, a lever portion formed so as to extend unidirectionally from a proximal end side thereof to a tip end side thereof with the proximal end side being rotatably attached to the first side surface of the housing so that the lever portion slides on the first side surface, and a guide groove formed from the tip end side of the lever portion to the proximal end side thereof in a size allowing insertion of a tip end of the pin and by which the pin is guided following the movement of the plate, the lever portion moving to a position of closing the first detection window when the ink runs out; and a second detecting member that detects a full state of the ink bag, the second detecting member being mounted to undergo movement following movement of the plate within the housing and to undergo movement to a position of closing the second detection window when at least a preselected amount of the ink is stored in the ink bag, the second detecting member having a protruding portion formed integrally with a side surface of the plate and protruding outwardly from the plate in a direction away from the ink bag, the protruding portion moving to a position of closing the second detection window when at least the preselected amount of the ink is stored in the ink bag.

2. An ink cartridge according to claim 1; wherein:

the plate is fixed to a center portion of the upper surface of the ink bag so as to extend in a longitudinal direction of the housing;

the first detection window is formed at a substantial center of the first side surface of the housing in the longitudinal direction thereof; and the second detection window is formed at a substantial center of the second side surface of the housing in the longitudinal direction thereof.

3. An ink cartridge according to claim 1; wherein the housing is provided with a guide member for guiding a rotational movement of the lever portion.

4. A recording apparatus, comprising:

the ink cartridge according to claim 1;

a detection unit that detects opened/closed states of the first detection window and the second detection window, and detects a residual amount of the ink stored in the ink bag based on a result of the detection;

a recording head that ejects ink droplets on a recorded medium and performs recording thereon;

an ink supply tube that is connected to the outflow port and supplies the ink from the ink cartridge to the recording head;

a carriage portion that houses the recording head and slidingly moves the recording head on the recorded medium; and a recorded medium conveyor portion that conveys the recorded medium.

5. A recording apparatus according to claim 4; wherein the detection unit includes:

a first detection unit that applies detection light toward the first detection window and detects the opened/closed state of the first detection window based on whether or not reflection of the detection light occurs; and a second detection unit that applies detection light toward the second detection window and detects the opened/closed state of the second detection window based on whether or not reflection of the detection light occurs.

6. An ink cartridge comprising:

a flexible ink bag for storing ink and which undergoes expansion and contraction movement in accordance with fluctuations in the amount of ink stored in the ink bag, the ink bag having an ink inlet port for supplying ink into the ink bag and an ink outlet port for discharging ink stored in the ink bag;

a housing for accommodating the ink bag, the housing having a first side surface, a second side surface opposite the first side surface, and a front surface extending between the first and second side surfaces;

an inflow port formed in the front surface of the housing for connection to the ink inlet port of the ink bag;

an outflow port formed in the front surface of the housing for connection to the ink outlet port of the ink bag;

a first detection window formed on the first side surface of the housing and via which an empty state of the ink bag is detected;

a second detection window formed on a second side surface of the housing opposite the first side surface thereof and via which a full state of the ink bag is detected;

a plate member mounted to an upper surface of the ink bag for movement therewith in response to fluctuations in the amount of ink stored in the ink bag, the plate member having a protruding portion that closes the second detection window during movement thereof to detect the full state of the ink bag; and a lever having a structure separate and independent from the plate member and being mounted to undergo movement with the plate member to close the first detection window to detect an empty state of the ink bag.

7. A recording apparatus, comprising:

the ink cartridge according to claim 6;

a detection unit that detects opened/closed states of the first detection window and the second detection window, and detects a residual amount of the ink stored in the ink bag based on a result of the detection;

a recording head that ejects ink droplets on a recorded medium and performs recording thereon;

an ink supply tube that is connected to the outflow port and supplies the ink from the ink cartridge to the recording head;

a carriage portion that houses the recording head and slidingly moves the recording head on the recorded medium; and a recorded medium conveyor portion that conveys the recorded medium.

8. A recording apparatus according to claim 7; wherein the detection unit includes:

a first detection unit that applies detection light toward the first detection window and detects the opened/closed state of the first detection window based on whether or not reflection of the detection light occurs; and a second detection unit that applies detection light toward the second detection window and detects the opened/closed state of the second detection window based on whether or not reflection of the detection light occurs.

* * * * *